United States Patent [19]

Stahlecker et al.

[11] 4,112,659

[45] Sep. 12, 1978

[54] OPEN END SPINNING UNIT WITH A BRAKING DEVICE

[76] Inventors: Fritz Stahlecker, Josef-Neidhart-Str. 18, 7341 Bad Ueberkingen; Hans Stahlecker, Haldenstrasse 20, 7334 Suessen, both of Fed. Rep. of Germany

[21] Appl. No.: 746,068

[22] Filed: Nov. 30, 1976

[30] Foreign Application Priority Data

Dec. 6, 1975 [DE] Fed. Rep. of Germany ..... 2555059

[51] Int. Cl.[2] ..... D01H 1/241; D01H 1/12

[52] U.S. Cl. ..... 57/58.89; 57/88

[58] Field of Search ..... 57/58.89–58.95, 57/34 R, 78, 88

[56] References Cited

U.S. PATENT DOCUMENTS

| | | | |
|---|---|---|---|
| 3,511,045 | 5/1970 | Bures et al. | 57/58.95 X |
| 3,750,381 | 8/1973 | Greenwood et al. | 57/58.91 |
| 3,756,007 | 9/1973 | Bartling | 57/58.91 |
| 3,846,967 | 11/1974 | Braun | 57/78 |
| 3,874,154 | 4/1975 | Stahlecker et al. | 57/58.95 |
| 3,879,926 | 4/1975 | Bartling et al. | 57/58.95 |

*Primary Examiner*—Richard C. Queisser
*Assistant Examiner*—Charles Gorenstein
*Attorney, Agent, or Firm*—Craig & Antonelli

[57] ABSTRACT

Spinning machine apparatus is provided which includes a vacuum housing for a spinning rotor which has a moveable housing section which forms a lid. A brake lever which serves to actuate a rotor brake simultaneously serves as a locking lever for locking the moveable housing section in the closed position such that movement of this lever from the locking position automatically actuates the brake so that the rotor is braked prior to actual opening movement of the housing section forming the lid.

12 Claims, 4 Drawing Figures

OPEN END SPINNING UNIT WITH A BRAKING DEVICE

BACKGROUND AND SUMMARY OF THE INVENTION

This invention relates to a spinning unit with a braking device for a spinning rotor turning within a housing closed off by a lid, this lid pertaining to a housing section which can be moved out of the way to uncover the spinning rotor; the opening thereof being transmitted to the braking device by means of transmission members. Preferred embodiments of the invention relate to open-end spinning units with a spinning rotor rotating in a vacuum housing.

In order to make the spinning rotor accessible for a servicing operation, it is known to provide a housing section which can be moved out of the way, this section constituting a lid for the vacuum housing surrounding the spinning rotor. During the opening step, it is necessary to brake at least the spinning rotor. For this purpose, it is coventional (DOS [German Unexamined Laid-Open Application] No. 2,109,975) to provide transmission means which transmit the movement of the removable housing section to the braking device and trigger a braking of the spinning rotor. Since in this type of structure the opening motion proper is utilized for the actuation of the brake, it can happen that the spinning rotor is entirely arrested only after the spinning unit has been completely opened. Under certain circumstances, the danger of accidents can thus be evoked. Besides, it is possible in this kind of construction that, after releasing the locking mechanism securing the housing section in the closed position, only a partial opening movement is executed so that the spinning rotor is not braked with the full braking power. This can result in damage since in such a case the drive mechanism as well as the brake are partially effective on the spinning rotor, so that the latter can overheat.

The invention is based on the problem of fashioning an open-end spinning unit of the type described in the foregoing so that, upon the opening of the vacuum housing of the spinning rotor, a secure braking action is obtained without the braking action being dependent on the opening movement proper. The invention contemplates providing that the transmission means for the braking action are connected to the locking mechanism securing the housing section.

This construction makes it possible to actuate the brake already with the release of the locking mechanism so that it makes no difference whether subsequently the vacuum housing is opened, by moving the closing housing section out of the way, in a gradual or rapid manner, or only partially. At the same time, the advantage is achieved that already present components must take over additional functions, resulting in a relatively economical construction.

In an advantageous embodiment of the invention, a brake lever pivotable about a stationary axis is provided, which lever is constructed as a locking lever and is associated with a latch of the housing section. This results in a very simple and yet safe construction. To ensure that the braking effect does not decrease after the unlocking step, a further development of the invention provides that the brake lever, with the vacuum housing being open, is held in the braking position by the housing section which can be moved out of the way.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
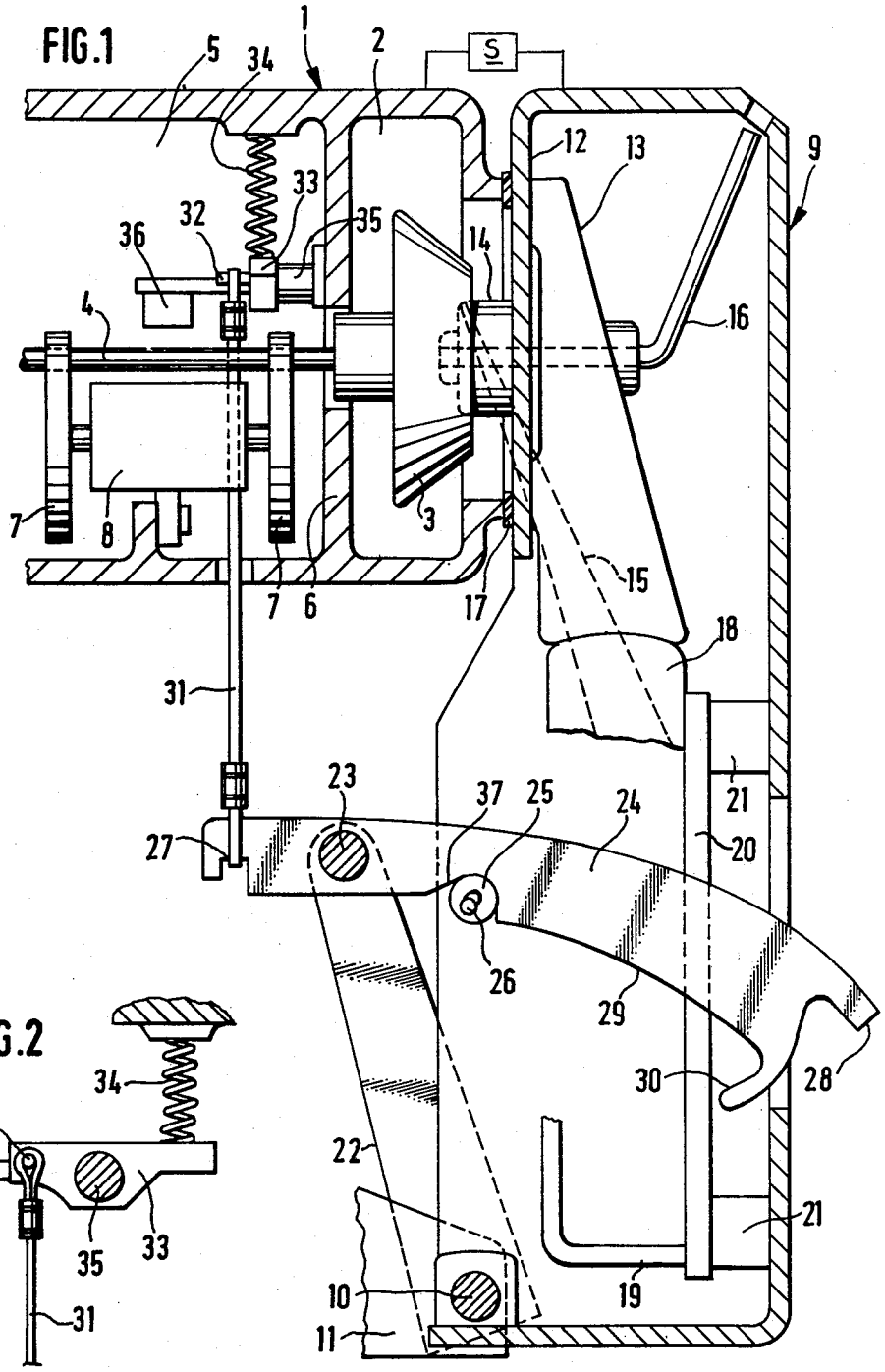
FIG. 1 is a vertical sectional view of an open-end spinning unit constructed in accordance with this invention.

FIG. 1 shows an open-end spinning unit 1, wherein a spinning rotor 3 rotates within a vacuum housing 2. The spinning rotor 3 is provided with a rotor shaft 4 extended through a bore disposed in rear wall 6 of the vacuum housing 2 and being supported in a separate duct 5 extending preferably in the longitudinal direction of the spinning machine. For supporting shaft 4, two pairs of supporting rollers 7 are provided, the bearing block 8 of which is held in the duct 5. The supporting roller pairs 7 form a V-slot for the rotor shaft 4.

The spinning unit 1 is covered by a housing section 9 pivotable about a stationary axle 10 arranged at the machine frame 11. A wall 12 of the housing section 9 contacts an opening of the vacuum housing 2, thus acting as a lid. Between the lid and the opening, a sealing element 17 is arranged. The housing section 9 contains an insert 13 which contains a cylindrical extension 14 projecting into the spinning rotor 3, a fiber feed duct 15, and a yarn take-off duct 16.

The insert 13 of the partial housing 9, which can be swung out of the way, can slide, during the opening motion, over a corresponding surface of a fixedly arranged duct insert 18 emanating from an opening device for silver, not shown. Numeral 19 denotes a lower wall of this opening device. A further lid 20 is mounted to the pivotable housing section 9 with the interposition of elastic elements 21. This further lid 20 elastically contacts the fixed parts 18 and/or 19 of the opening device when the partial housing 9 is being closed, thus compensating for the tolerances occurring during the closing movement between the housing section 9, on the one hand, and the fixed parts of the opening device and/or of the vacuum housing, on the other hand.

A holder 22 is immovably arranged on the swivel axle 10. This holder 22 receives a rotary axle 23 for a brake lever 24. This rotary axle 23 could also be arranged at any other stationary component according to other preferred non-illustrated embodiments. This brake lever 24 serves, in the manner described hereinbelow, for braking the spinning rotor 3 as well as for locking the pivotable housing section 9 in position. For this purpose, a locking roller 25 is provided on a preferably eccentric pin 26 at the pivotable housing section 9. The brake lever 24 extends over this roller 25 by means of a cutout 37. The brake lever 24 is extended past its rotary axle 23. At this end, the brake lever has an indentation 27 in which is hung a belt 31 for actuating the rotor brake. The brake lever 24 extending with a projection 28 from the pivotable partial housing 9 has, subsequently to the cutout 37, a circular guiding surface 29 limited by a stop 30.

Figure 2:
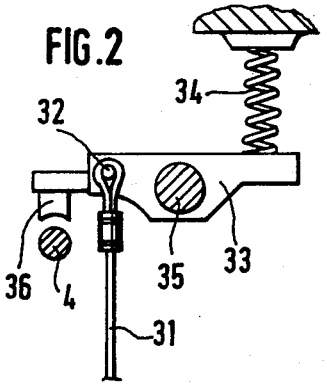
FIG. 2 is a partial view of FIG. 1 as seen in the direction of the rotor axis.

As can be seen particularly from FIG. 2 in conjunction with FIG. 1, the belt 31 held by the brake lever 24 is looped with its other end in the bearing duct 5 about a pin 32 attached to a double lever 33. This double lever 33 is pivotable about a stationary axle 35 held at the rear wall 6 of the vacuum housing 2. A brake 36 is arranged at an extension of the double lever 33 which is held in its position wherein it is lifted off the rotor shaft 4 by means of a compression spring 34.

Figure 3:
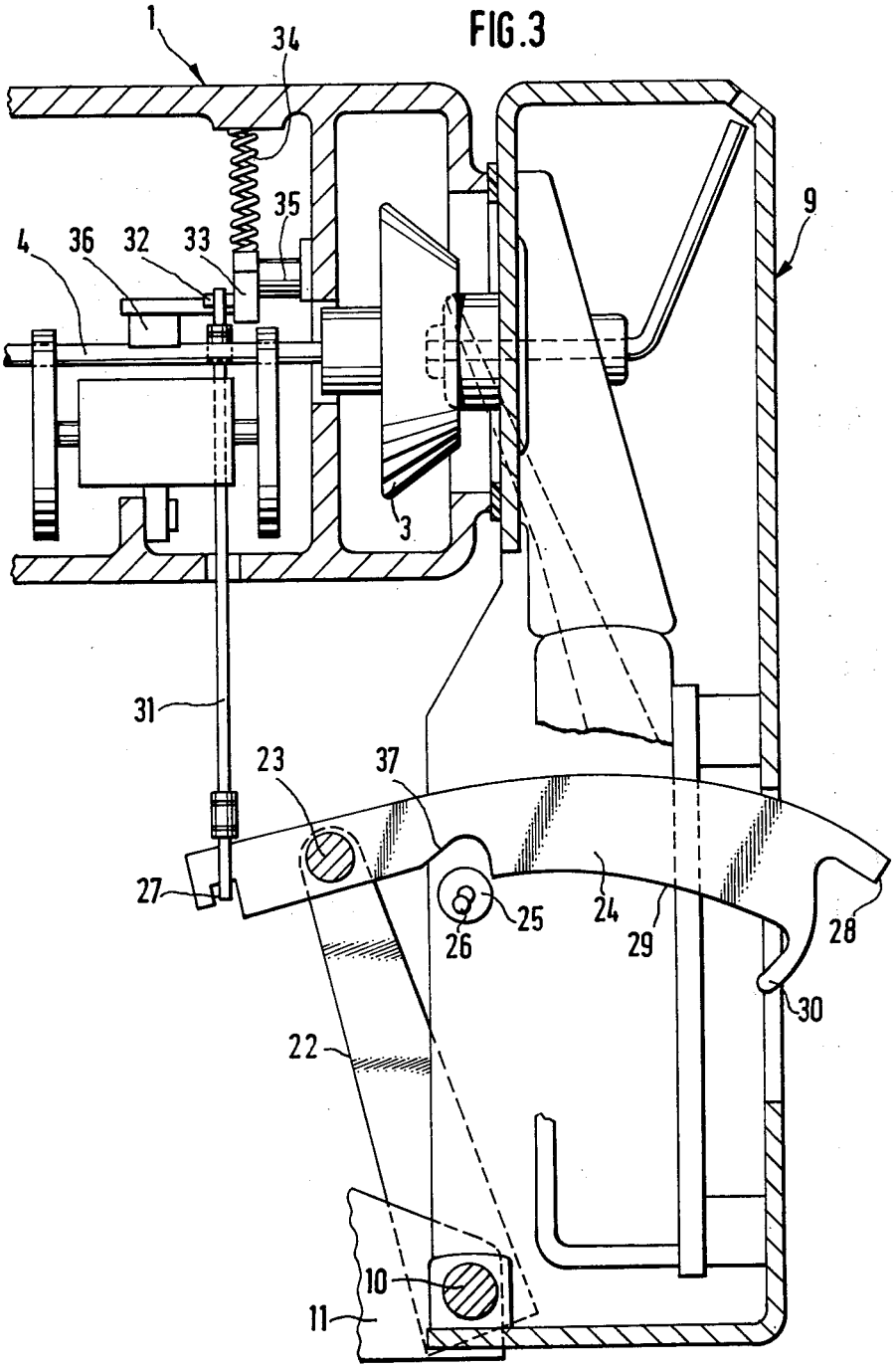
FIG. 3 shows the open-end spinning unit of FIG. 1 with the brake having been applied.

Due to the fact that the brake lever 24 extends over the locking roller 25 with its cutout 37, the housing portion 9 is locked in the closed condition, as described hereinabove. In order to open the spinning unit, i.e. to swing the housing section 9 out of the way, the brake lever 24 is lifted in the counterclockwise direction until it is entirely free of the locking roller 25. During this step, the brake 36 arranged at the double lever 33 (see also FIG. 2) moves downwardly against the pressure of the spring 34 and contacts the rotor shaft 4. In this way, the spinning rotor 3 is braked with the full braking force already while the housing section 9 is being unlocked, but while the vacuum housing 2 is still closed. This situation is illustrated in FIG. 3.

Figure 4:
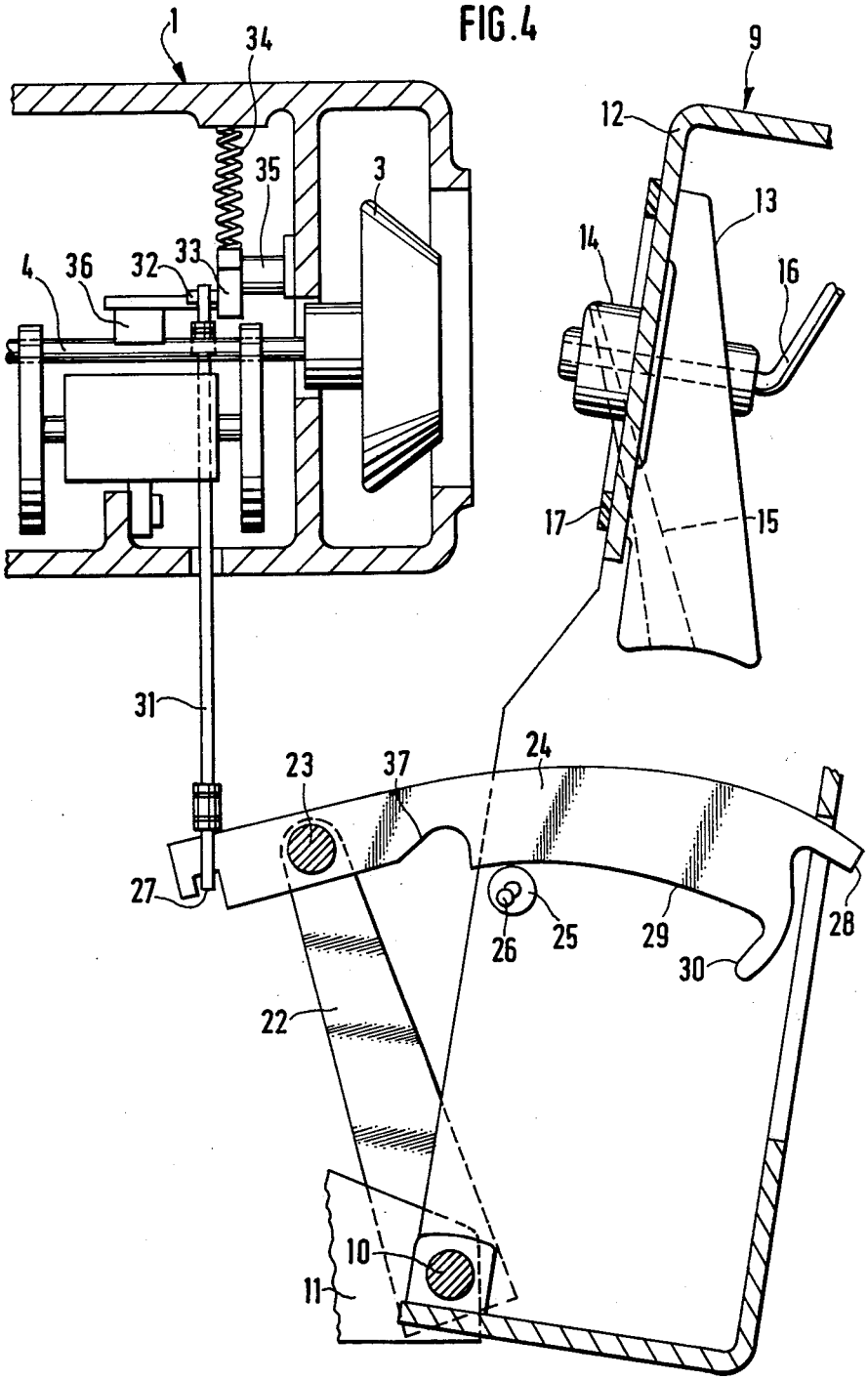
FIG. 4 shows the open-end spinning unit of FIGS. 1 and 3 in the open condition.

During the subsequent swinging away of the housing section 9, the brake 36 remains in engagement with the turbine shaft 4, because the guiding surface 29 of the brake lever 24 is guided over the locking roller 25 (see FIG. 4). The locking roller 25 arranged at the housing section 9 can slide along the guide surface 29 until it abuts the stop 30 of the brake lever 24. In this position, the opening motion is terminated. The guide surface 29 of the brake lever 24 is a circular path, the radius of which amounts approximately to the distance of the eccentric pin 26 plus the radius of the locking roller 25 from the pivot axle 10. This ensures that the brake lever 24 does not continue to move and change the braking effect when it has been lifted out of the locking roller.

Due to the extension 28 of the brake lever 24 projecting from the front side of the housing section 9, the rotor brake 36 can also be operated while the housing section 9 is closed. In this connection, care must merely be taken that the housing section 9 remains pressed against the turbine housing while the brake lever 24 is being lifted. This can be realized especially easily if the brake lever 24 and/or its extension 28 are operated by means of a servicing unit movable along the open-end spinning machine. However, in certain circumstances it is advantageous to provide an additional, resilient detent means (schematically shown at S in FIG. 1) in order to maintain the housing section 9 in the closed position.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Spinning machine apparatus comprising:

a spinning rotor, a vacuum housing for said spinning rotor, a movable housing section which forms a lid for said vacuum housing, a first detent means on said movable housing section, braking means for applying braking forces to the spinning rotor, and a brake lever for controlling operation of said braking means with said braking means being in a braking position when said brake lever is in a first brake operating position and with said braking means being in a non-braking position when said brake lever is in a second brake non-operating position, said brake lever including a second detent means and a guide surface extending from immediately adjacent said second detent means, said second detent means being configured to lockingly engage said first detent means when said housing section is in a closed position and said brake lever is in its second brake non-operating position, said guide surface being configured to engage said first detent means to maintain said brake lever in its first brake operating position whenever said housing section is moved away from its closed position such that continuous braking force is applied to said rotor for all opened positions of the housing section, whereby said brake lever serves both as a brake control lever and a latch for said housing section, while also assuming automatic actuation of said braking means when said housing section is open irrespective of the position of said housing section.

2. Apparatus according to claim 1, wherein said brake lever is pivotable about a stationary axle.

3. Apparatus according to claim 2, wherein the housing section is mounted for pivotal movement about a stationary axle which is parallel to the stationary axle for the brake lever, and wherein said brake lever guide surface extends approximately concentric to the stationary axle for said housing section.

4. Apparatus according to claim 1, wherein said guide surface is limited toward its outside by a stop engageable with the locking pin when the housing section is in a fully opened position.

5. Apparatus according to claim 1, further comprising spring detent means separate from said locking means for resiliently biasing said housing section towards its closed position.

6. Apparatus according to claim 1, wherein said first detent means is a locking pin, wherein said second detent means is a cutout groove on said brake lever, and wherein said guide surface extends from said cutout groove and is abuttingly engageable with the locking pin when said housing section is in an open position.

7. Apparatus according to claim 6, wherein said guide surface is limited toward its outside by a stop engageable with the locking pin when the housing section is in a fully opened position.

8. Apparatus according to claim 7, wherein the housing section is mounted for pivotal movement about a stationary axle which is parallel to the stationary axle for the brake lever, and wherein said guide surface extends approximately concentrically to the stationary axle for said housing section.

9. Apparatus according to claim 8, wherein said locking pin is in the form of a locking roller which is adjustably arranged on the housing section.

10. Apparatus according to claim 9, further comprising spring detent means separate from said locking means for resiliently biasing said housing section towards its closed position.

11. Apparatus according to claim 7, wherein said locking pin is in the form of a locking roller which is adjustably arranged on the housing section.

12. Apparatus according to claim 7, further comprising spring detent means separate from said locking means for resiliently biasing said housing section towards its closed position.

* * * * *